US010796843B2

(12) United States Patent
Kitahara

(10) Patent No.: US 10,796,843 B2
(45) Date of Patent: Oct. 6, 2020

(54) ANTENNA COIL AND ANTENNA DEVICE

(71) Applicant: Tokyo Parts Industrial Co., Ltd., Gunma-ken (JP)

(72) Inventor: Takahisa Kitahara, Gunma-ken (JP)

(73) Assignee: Tokyo Parts Industrial Co., Ltd. (JP)

( * ) Notice: Subject to any disclaimer, the term of this patent is extended or adjusted under 35 U.S.C. 154(b) by 108 days.

(21) Appl. No.: 16/247,666

(22) Filed: Jan. 15, 2019

(65) Prior Publication Data

US 2019/0311843 A1 Oct. 10, 2019

(30) Foreign Application Priority Data

Apr. 9, 2018 (JP) ..... 2018-074373

(51) Int. Cl.
*H01Q 1/22* (2006.01)
*H01F 27/30* (2006.01)
*H01F 5/02* (2006.01)

(52) U.S. Cl.
CPC ..... *H01F 27/306* (2013.01); *H01F 5/02* (2013.01); *H01Q 1/2283* (2013.01)

(58) Field of Classification Search
CPC ..... H01Q 7/08; H01Q 1/3241; H01Q 1/42
See application file for complete search history.

(56) References Cited

U.S. PATENT DOCUMENTS 9,673,524 B2 * 6/2017 Stakanov ..... H01Q 1/243
2001/0026244 A1 * 10/2001 Ieda ..... E05B 81/78 343/867
2002/0163474 A1 * 11/2002 Ieda ..... H01Q 21/29 343/742
2004/0257296 A1 * 12/2004 Ieda ..... B60R 25/246 343/872
2006/0214866 A1 * 9/2006 Araki ..... H01Q 7/08 343/788
2007/0075828 A1 * 4/2007 Mizushima ..... E05B 81/78 340/5.62
2007/0075913 A1 * 4/2007 Moriya ..... H01Q 7/06 343/895
2007/0080882 A1 * 4/2007 Ohara ..... H01Q 1/325 343/788
2008/0068129 A1 * 3/2008 Ieda ..... E05B 85/16 340/5.72

(Continued)

FOREIGN PATENT DOCUMENTS

JP 2016052035 A 4/2016
JP 2017050809 A 3/2017

(Continued)

*Primary Examiner* — Graham P Smith
*Assistant Examiner* — Jae K Kim
(74) *Attorney, Agent, or Firm* — Jordan and Koda, PLLC

(57) ABSTRACT

Copper covered steel is used for metal terminals 50*a*, 50*b* in an antenna coil. Through holes penetrating in the Z direction and position restraining grooves that are formed continuous with these through holes are formed in a holder for holding the metal terminals 50*a*, 50*b*. Proceeding from the situation in which the metal terminals 50*a*, 50*b* have been driven into, so as to be press-fit in, the through holes in the holder, by bending the first ends in the Y direction and the second ends in the X direction, the first ends and the second ends are respectively fitted into position restraining grooves such that the positions of binding parts 50*a*1, 50*b*1 and lead wire connection parts 50*a*2, 50*b*2 are restrained.

16 Claims, 6 Drawing Sheets

(56) References Cited

U.S. PATENT DOCUMENTS

| | | | | |
|---|---|---|---|---|
| 2010/0164822 | A1* | 7/2010 | Iwasaki | H01Q 7/08 343/788 |
| 2014/0361949 | A1* | 12/2014 | Mahara | H01Q 1/1207 343/866 |
| 2016/0155591 | A1* | 6/2016 | Miura | H01F 27/325 335/202 |
| 2016/0315389 | A1* | 10/2016 | Imai | H01Q 1/24 |
| 2016/0372830 | A1* | 12/2016 | Hong | H01Q 1/2283 |
| 2017/0062915 | A1* | 3/2017 | Ando | H01Q 7/00 |
| 2017/0301995 | A1* | 10/2017 | Tanaka | H01Q 1/2208 |

FOREIGN PATENT DOCUMENTS

| | | | | |
|---|---|---|---|---|
| WO | WO-2008010329 | A1 * | 1/2008 | H01Q 1/40 |
| WO | WO-2008087802 | A1 * | 7/2008 | H01F 41/076 |

* cited by examiner

ANTENNA COIL AND ANTENNA DEVICE

BACKGROUND OF THE INVENTION

The present invention relates to an antenna coil and an antenna device, which is installed, for example, in a door handle of a vehicle, and which can be used in a communication system that performs locking and unlocking of a door by remote control.

Recent automobiles are equipped with keyless entry systems that lock and unlock doors without key operations. In keyless entry systems, the doors of a vehicle are locked and unlocked by way of remote control over short distances, with an LF band (low frequencies of 30 to 300 kHz) communication system, and an antenna device that uses an antenna coil is installed in a door handle on the outside of the vehicle in order to communicate with a portable device carried by the user of the vehicle.

For example, Japanese Patent Laid-Open Publication No. 2016-52035 discloses an antenna device in which an antenna coil is arranged in a tubular case. In this antenna device, a coil is wound around a magnetic material core that is fixed in a resin holder, the two ends of the coil are each connected to one of the ends of two metal terminals that are fixed on the holder, and two lead wires, which are connected to the other ends of the metal terminals, are led out to the exterior of the case. These metal terminals are formed in an L shape and comprise a binding part that is formed by working, on which an end of the coil is bound, and a crimping terminal, which has a claw that engages the covering of the lead wire.

With the antenna device described in Japanese Patent Laid-Open Publication No. 2016-52035, even if the lead wires were to be pulled, the tensile force would be prevented from acting directly on the coil, such that disconnection of the coil can be prevented, and thus the durability and reliability are excellent. In addition, since the metal terminal has a binding part on which an end of the coil is bound, it is possible to wind the coil with an automatic machine.

However, the metal terminals used in the antenna device described in Japanese Patent Laid-Open No. 2016-52035 have complicated shapes, such that the parts cost is high, and thus there is a problem in that the manufacturing cost of the antenna device will be high.

SUMMARY OF THE INVENTION

One or more embodiments of the present invention provide an antenna coil and an antenna device, with which the coil can be wound by an automatic machine, and with which manufacturing costs can be reduced, while maintaining durability and reliability.

Note that, in the aspects described below, the constituent elements employed can be used in the most freely chosen combinations possible. Furthermore, the aspects and technical features of the present invention are not limited to those described hereafter, and are to be understood based on the description in the entire specification and the drawings or the inventive ideas that can be grasped by the skilled artisan on the basis of these descriptions.

A first aspect of the present invention is an antenna coil comprising:

a magnetic material core elongated in the X direction; a holder made of resin mounted on the magnetic material core; a coil wound on the magnetic material core; metal terminals having first ends to which the ends of the coil are electrically connected; and lead wires, which are electrically connected to second ends of the metal terminals, wherein:

the holder has a core holding part that holds the magnetic material core and a terminal holding part for holding the metal terminals;

the metal terminals are made of copper covered steel;

the terminal holding part has through holes penetrating in the Z direction and position restraining grooves formed continuous with the through holes, into which at least a portion of the metal terminals are fitted; and with the metal terminals press-fitted into the through holes, the first ends are bent in the Y direction, and second ends are bent in the X direction, such that the positions thereof are restrained by the position restraining grooves.

A second aspect of the present invention is an antenna coil comprising:

a magnetic material core elongated in the X direction; a holder made of resin mounted on the magnetic material core; a coil wound on the magnetic material core; metal terminals having first ends to which the ends of the coil are electrically connected; and lead wires which are electrically connected to second ends of the metal terminals, wherein:

the holder has a core holding part that holds the magnetic material core and a terminal holding part for holding the metal terminals;

the metal terminals are made of copper covered steel;

the terminal holding part has through holes penetrating in the Z direction and position restraining grooves formed continuous with the through holes, into which at least a portion of the metal terminals are fitted;

with the metal terminals press-fitted into the through holes, the first ends are bent in the Y direction, and the second ends are bent in the X direction, such that the positions thereof are restrained by the position restraining grooves;

the position restraining grooves are provided in a portion corresponding to first ends of the metal terminals and in a portion corresponding to the second ends of the metal terminals; and the depth of the position restraining grooves in the Z direction is equal to or greater than the height in the Z direction of the metal terminals fitted in the position restraining grooves.

A third aspect of the present invention is an antenna device in which an antenna coil is received in an outer case, wherein:

the antenna coil comprises: a magnetic material core elongated in the X direction; a holder made of resin mounted on the magnetic material core; a coil wound on the magnetic material core; metal terminals having first ends to which the ends of the coil are electrically connected; and lead wires which are electrically connected to second ends of the metal terminals;

the holder has a core holding part that holds the magnetic material core and a terminal holding part for holding the metal terminals;

the metal terminals are made of copper covered steel;

the terminal holding part has through holes penetrating in the Z direction and position restraining grooves formed continuous with the through holes, into which at least a portion of the metal terminals are fitted;

with the metal terminals press-fitted into the through holes, the first ends are bent in the Y direction, and the second ends are bent in the X direction, such that the positions thereof are restrained by the position restraining grooves; and the lead wires are led out in the X direction from the outer case.

With the present invention it is possible to effectively prevent bending and slipping of the binding parts and the lead wire connection parts of the metal terminals made from wire when binding the coil ends with an automatic machine, cutting off the extra wire, and then connecting the lead wires. Thus, it is possible to limit part costs and manufacturing costs of the antenna device, while maintaining durability and reliability.

DETAILED DESCRIPTION OF THE PREFERRED EMBODIMENTS

First Exemplary Mode of Embodiment

Figure 1:
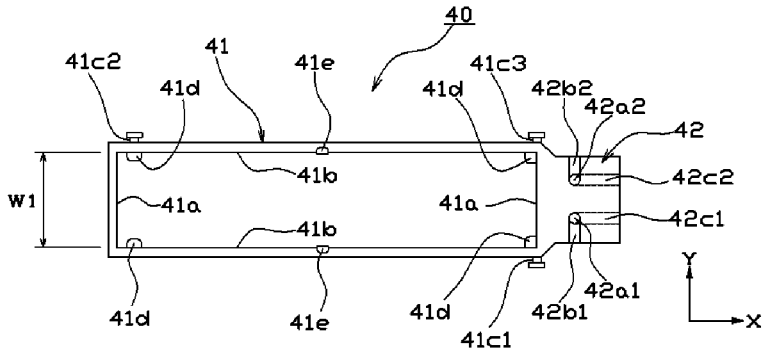
FIG. 1 shows a holder according to a first exemplary mode of embodiment of the present invention, wherein (a) is a top view, (b) is a bottom view, (c) is a side view, and (d) is a perspective view.
Figure 1:
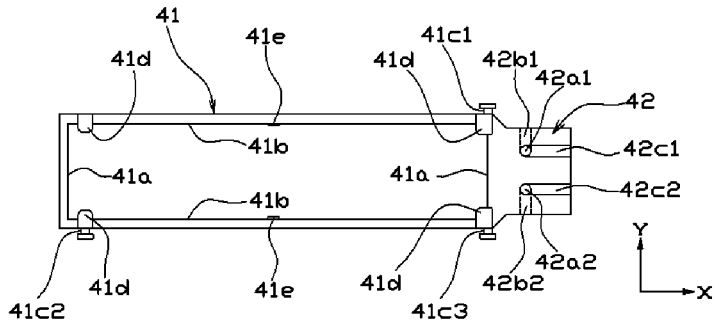
Figure 1:
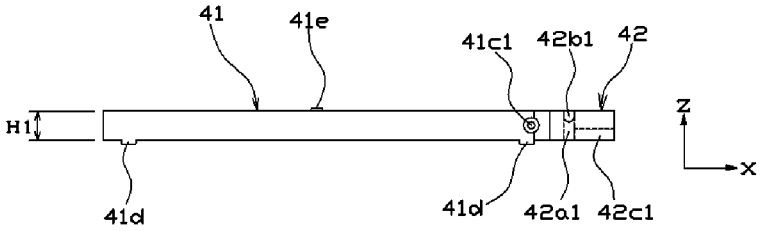
Figure 1:
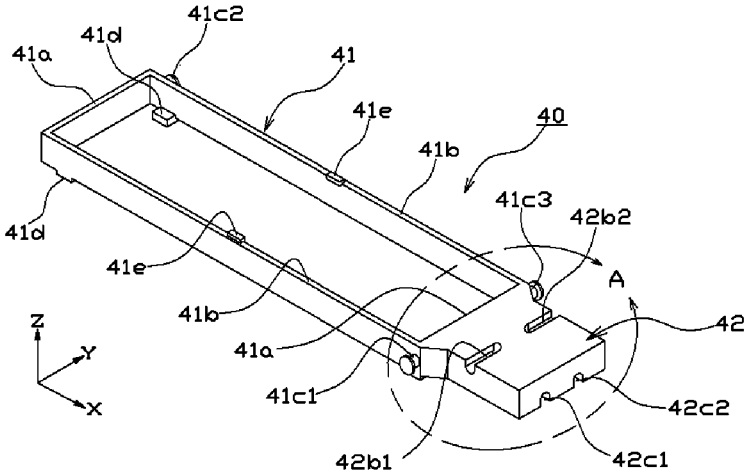

An antenna device 1 according to the first exemplary mode of embodiment of the present invention will be described with reference to FIGS. 1 to 7. The antenna device 1 in the present example is one in which an antenna coil 20 is housed in an outer case 10, and is installed inside a door handle of a vehicle equipped, for example, with a keyless entry system, and can be used as part of a communication system that locks and unlocks a door by remote control.

The antenna coil 20 principally comprises a magnetic material core 30, a holder 40, metal terminals 50*a* and 50*b*, a coil 60, and a lead wire 70.

The magnetic material core 30 has a flat substantially rectangular parallelepiped shape, elongated in the X direction (right/left direction in FIG. 4), and the width W2 in the Y direction is greater than the height H2 in the Z direction. There are no particular limitations on the material for the magnetic material core 30, as long as this has the desired magnetic characteristics, and any magnetic material such as a metal magnetic material, a Ni—Zn ferrite, a Mn—Zn ferrite or the like can be used.

The holder 40 is made from an integrally molded insulating resin, and is provided with a core holding part 41 that holds the magnetic material core 30 and a terminal holding part 42 that holds the metal terminals 50*a*, 50*b*.

The core holding part 41 has first covering parts 41*a* covering two surfaces of the magnetic material core 30 opposite each other in the X direction and second covering parts 41*b* covering two surfaces of the magnetic material core 30 opposite each other in the Y direction. The core holding part 41 is open in Z direction, and by slightly elastically deforming the second covering parts 41*b*, the magnetic material core 30 can be fitted in the internal space surrounded by the first covering parts 41*a* and the second covering parts 41*b*, via this portion that is open in the Z direction. The Y direction width W1 of the internal space of the core holding part 41 is configured to be the same as the width W2 of the magnetic material core 30. Meanwhile, the height H1 in the Z direction of the internal space of the core holding part 41 is configured to be slightly greater than the height H2 of the magnetic material core 30, such that the two end faces of the core holding part 41 in the Z direction protrude slightly beyond the two end faces of the magnetic material core 30 in the Z direction.

Restraining projections 41*d*, 41*e*, which restrain the movement, in the Z direction, of the magnetic material core 30, which is fitted on the core holding part 41, are provided at predetermined positions on the first covering parts 41*a* and the second covering parts 41*b*. Specifically, four restraining projections 41*d* are provided, which protrude slightly toward the internal space from the bottom of the core holding part 41, and two restraining projections 41*e* are provided, which protrude slightly toward the internal space from the top of the core holding part 41. The distance in the Z direction from the top of the restraining projection 41*d* to the bottom of the restraining projection 41*e* is configured to be equal to the height H2 of the magnetic material core 30.

On the outer surfaces of the second covering parts 41*b*, three binding parts are provided, on which the coil 60 is bound. Specifically, on one second covering part 41*b*, a binding part 41*c*1 is provided only in a portion close to the terminal holding part 42, while on the other second covering part 41*b*, a binding part 41*c*2 and a binding part 41*c*3 are respectively provided in a portion distant from the terminal holding part 42 and in a portion close to the terminal holding part 42. These binding parts protrude in the Y direction from the outer surfaces of the second covering parts 41*b*, the tips thereof being formed expanding in a flange shape.

The terminal holding part 42 is a part extending in the X direction from one first covering part 41*a* of the core holding part 41, and holds the two metal terminals 50*a*, 50*b*. Two through holes 42*a*1, 42*a*2 that penetrate in the Z direction at predetermined positions, two X position restraining grooves 42*b*1, 42*b*2, and two Y position restraining grooves 42*c*1, 42*c*2 are formed in this terminal holding part 42.

The sectional shape of the through holes 42a1, 42a2 in the X-Y plane is preferably the same as the sectional shape of the metal terminals 50a, 50b, and is circular in the present example. The X position restraining groove 42b1 is formed extending in the Y direction, continuous from the upper end of the through hole 42a1. The X position restraining groove 42b2 is formed extending in the Y direction, continuous from the upper end of the through hole 42a2. Furthermore, the Y position restraining groove 42c1 is formed extending in the X direction, continuous from the lower end of the through hole 42a1. The Y position restraining groove 42c2 is formed extending in the X direction, continuous from the lower end of the through hole 42a2.

The depth in the Z direction of the X position restraining grooves 42b1, 42b2 and the Y position restraining grooves 42c1, 42c2 is preferably equal to or greater than the height in the Z direction of the metal terminals 50a, 50b fitted therein, and in the present example, is established so as to be substantially equal to the diameter of the metal terminals 50a, 50b. Furthermore, bottoms of the X position restraining grooves 42b1, 42b2 and the Y position restraining grooves 42c1, 42c2 are preferably shaped so as to follow the outer peripheral faces of the metal terminals 50a, 50b and, in this example, are curved in a semicircular circular arc.

Copper covered steel is used for the metal terminals 50a, 50b. Copper covered steel is a wire material in which copper (or copper and tin) is coated on the outer peripheral face of a steel wire, and thus has the same soldering characteristics as copper but has higher toughness and strength than copper wire.

Figure 2:
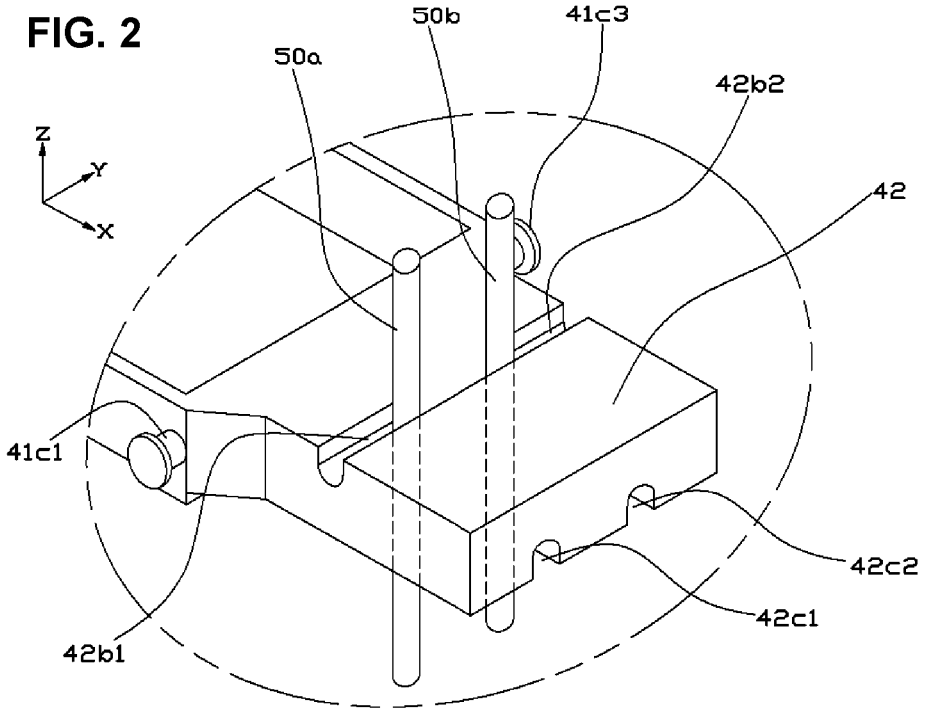
FIG. 2 is an enlarged perspective view of a portion A in FIG. 1 (*d*), showing the situation in which straight metal terminals have been press-fitted into the holder according to the first exemplary mode of embodiment of the present invention.
Figure 3:
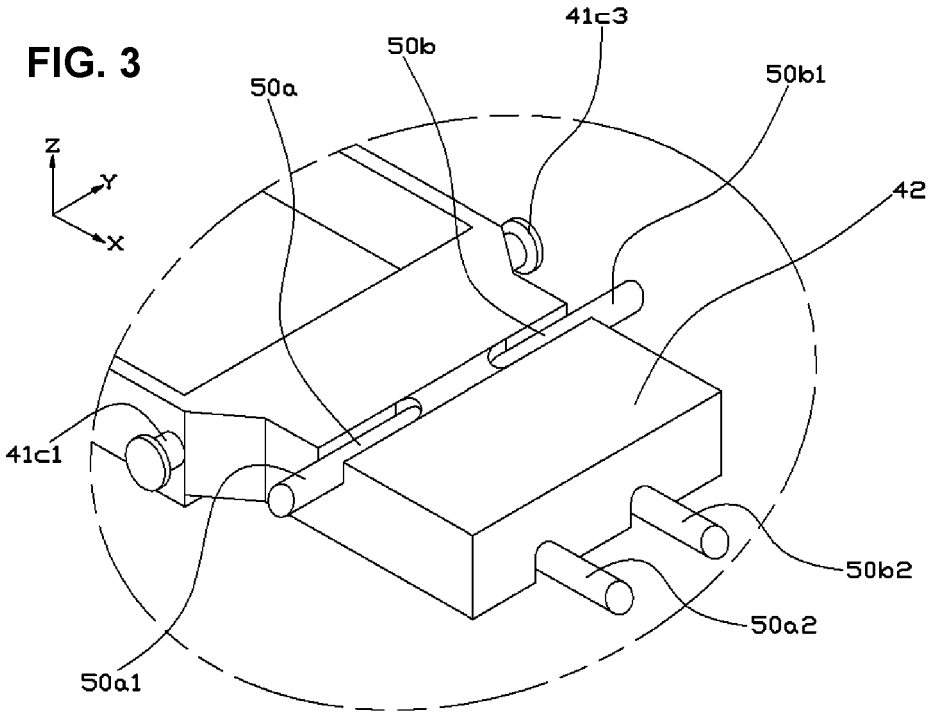
FIG. 3 is an enlarged perspective view of the portion A in FIG. 1 (*d*), showing the situation in which the straight metal terminals have been press-fitted into a holder according to the first exemplary mode of embodiment of the present invention, and then the metal terminals have been bent.
Figure 4A:
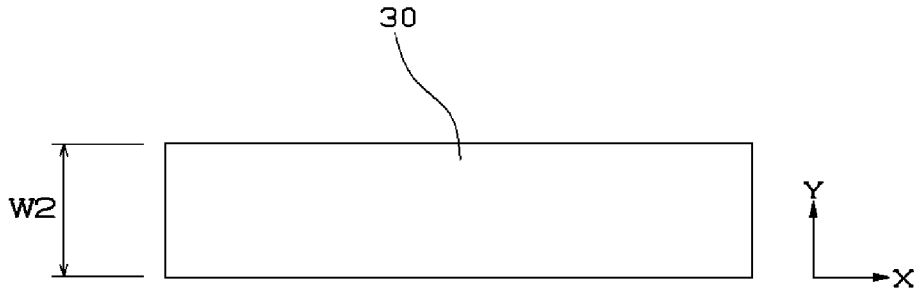
FIG. 4 shows a magnetic material core according to a first exemplary mode of embodiment of the present invention, wherein (a) is a top view and (b) is a side view.
Figure 4B:
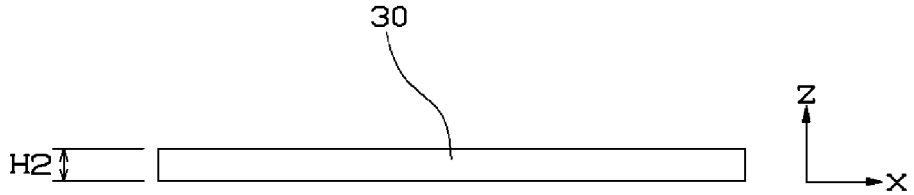
Figure 5:
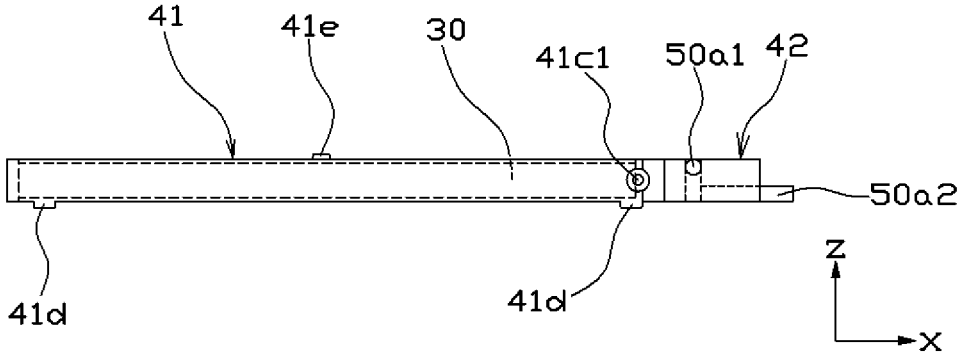
FIG. 5 is a side view showing the situation in which the magnetic material core in FIG. 3 has been fitted, after the metal terminals have been attached to the holder in FIG. 1.

After the two metal terminals 50a, 50b are respectively driven through the through holes 42a1, 42a2, and thus press-fitted in the through holes 42a1, 42a2, in the terminal holding part 42, as shown in FIG. 2, the first ends are bent in the Y direction while the second ends are bent in the X direction, as shown in FIG. 3. Specifically, the first ends of two metal terminals 50a, 50b are bent in opposite directions from one another in the Y direction and respectively received in the X position restraining grooves 42b1, 42b2, and the binding parts 50a1, 50b1 at the leading ends are led out from the terminal holding parts 42 to the exterior. Furthermore, the second ends of the two metal terminals 50a, 50b are bent in the same direction, in the X direction, and respectively received in the Y position restraining grooves 42c1, 42c2, and the lead wire connection parts 50a2, 50b2 at the leading ends are led out from the terminal holding part 42 to the exterior.

The coil 60 is made of a single conductor covered with a heat-resistant resin such as polyimide, and is wound around the outer periphery of the magnetic material core 30, which is mounted in the core holding part 41. Specifically, after a coil end 61a on the winding-start side is bound to the binding parts 50a1, 41c1, the coil is wound around the outer periphery of the second covering part 41b of the core holding part 41 then bound to the binding part 41c2, whereafter the coil end 61b on the winding-end side is finally bound to the binding parts 41c3, 50b1.

Both Z-direction end faces of the core holding parts 41 protrude slightly beyond both Z-direction end faces of the magnetic material core 30, such that a slight gap is present between the coil 60 that has been wound around the outer periphery of the second covering parts 41b and the magnetic material core 30. Therefore, even if, for example, Mn—Zn ferrite, which has low resistivity, is used as the magnetic material core 30, isolation can be maintained between the magnetic material core 30 and the coil 60.

The two lead wires 70 comprise a conductor 71 at the center and an insulating covering 72, which covers this conductor 71, and which is stripped so as to expose a predetermined length of the conductor 71 at the leading end. The conductors 71 of these two lead wires 70 are respectively electrically connected to the lead wire connection parts 50a2, 50b2. There are no particular limitations on the method of connecting these conductors 71 and the lead wire connection parts 50a2, 50b2 and, in addition to solder connections, this can also be performed by way of resistance welding, for example.

Figure 6:
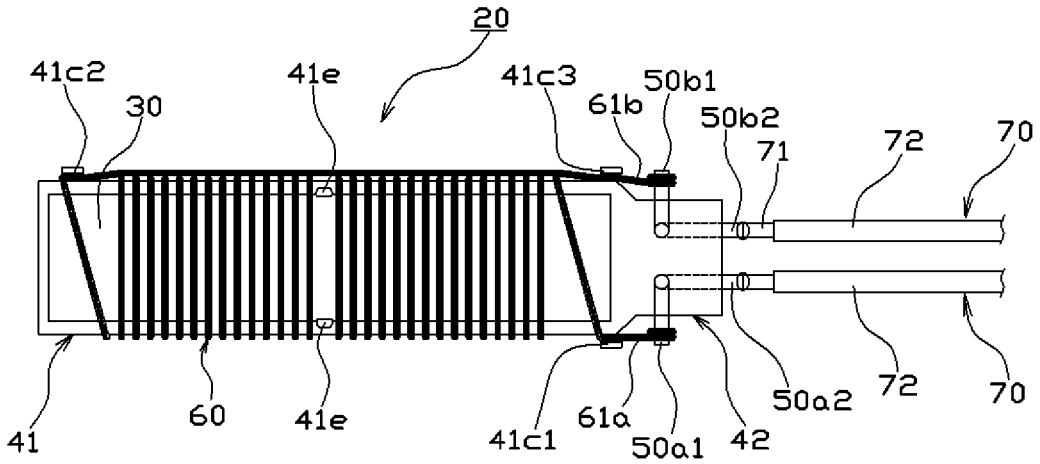
FIG. 6 is a top view of the antenna coil according to the first exemplary mode of embodiment of the present invention.
Figure 7:
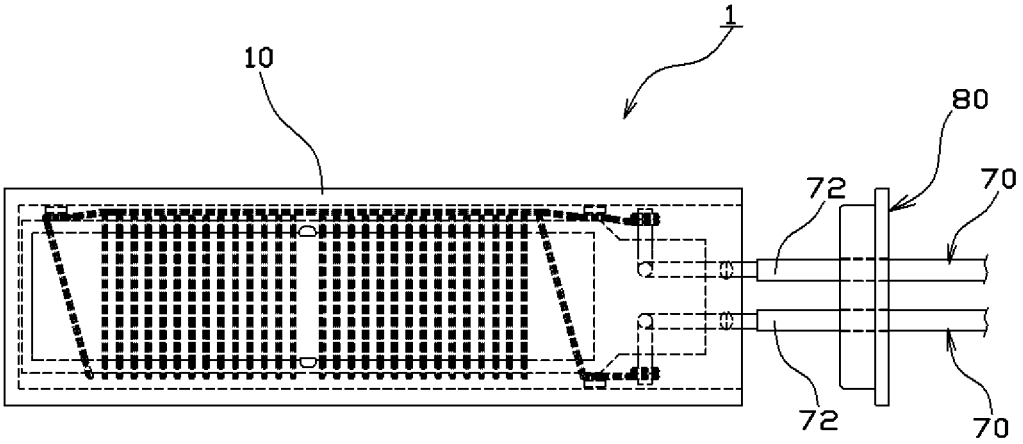
FIG. 7 is a top view illustrating the antenna device according to the first exemplary mode of embodiment of the present invention.

The antenna coil 20 in FIG. 6, which is configured in this manner, is inserted into a bottomed tubular outer case 10, which is made from an insulating resin, as shown in FIG. 7. At this time, one of the first covering parts 41a and the three binding parts 41c1, 41c2, 41c3 are brought into contact with the inner walls of the outer case 10 so as to position the antenna coil 20 and, if necessary, the space remaining in the outer case 10 is filled with a filler made from a soft resin. Furthermore, the open end of the outer case 10 is closed by a closing member 80 that is made from an insulating resin and the two lead wires 70 are led out to the exterior via the two holes provided in the closing member 80, whereby the antenna device 1 is completed.

In the antenna device 1 of the present example described above, copper covered steel, which is a wire material having higher toughness and strength than copper wire, is used for the metal terminals 50a, 50b. Furthermore, proceeding from the situation in which the metal terminals 50a, 50b have been driven into the through holes 42a1, 42a2, so as to be press-fit in the through holes 42a1, 42a2, in the holder 40, by bending the first ends in the Y direction and the second ends in the X direction, the first ends and the second ends are respectively fitted into the X position restraining grooves 42b1, 42b2 and the Y position restraining grooves 42c1, 42c2, such that the positions thereof are restrained. It is thereby possible to effectively prevent bending and slipping of the binding parts 50a1, 50b1 and the lead wire connection parts 50a2, 50b2 of the metal terminals 50a, 50b, when binding the coil end with the automatic machine, cutting off the extra wire, and then connecting the lead wires 70. Thus, it is possible to limit part costs and manufacturing costs of the antenna device, while maintaining durability and reliability.

Furthermore, in the antenna device 1 of the present example, a round wire having a circular cross section is used for the metal terminals 50a, 50b, and the bottoms of the X position restraining grooves 42b1, 42b2 and the Y position restraining grooves 42c1, 42c2 are formed in a semicircular shape. In addition, since the X position restraining grooves 42b1, 42b2 and the Y position restraining grooves 42c1, 42c2 are formed continuous with the through holes 42a1, 42a2, the metal terminals 50a, 50b that have been bent in the two directions are stably positioned.

Furthermore, in the antenna device 1 of the present example, the depth in the Z direction of the X position restraining grooves 42b1, 42b2 and the Y position restraining grooves 42c1, 42c2 is equal to or greater than the height of the metal terminals 50a, 50b in the Z direction. Therefore, it is possible to receive the metal terminals 50a, 50b which have been bent in two directions within the thickness of the holder 40. In addition, the core holding part 41 of the holder 40 includes the first covering parts 41a covering the two surfaces of the magnetic material core 30 opposite each other in the X direction, and the second covering parts 41b covering the two surfaces of the magnetic material core 30 opposite each other in the Y direction, and the core holding part 41 is open in the Z direction. Consequently, it is possible to limit the height of the antenna coil 20 in the Z direction, and thus limit the thickness of the overall antenna device, such that this will be suitable for mounting in a door handle having a constrained internal space.

Second Exemplary Mode of Embodiment

Figure 8:
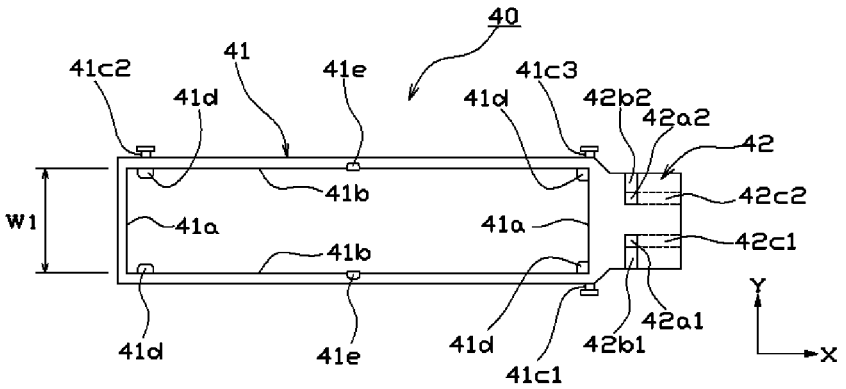
FIG. 8 shows a holder according to a second exemplary mode of embodiment of the present invention, wherein (a) is a top view, (b) is a bottom view, (c) is a side view, and (d) is a perspective view.
Figure 8:
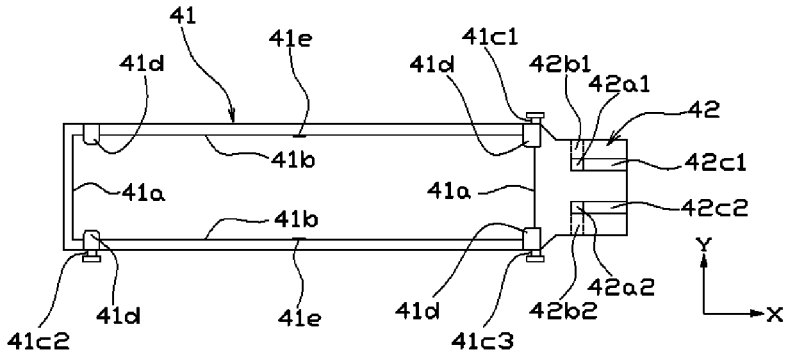
Figure 8:
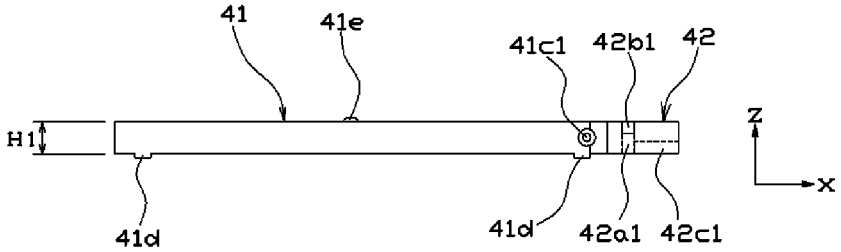
Figure 8:
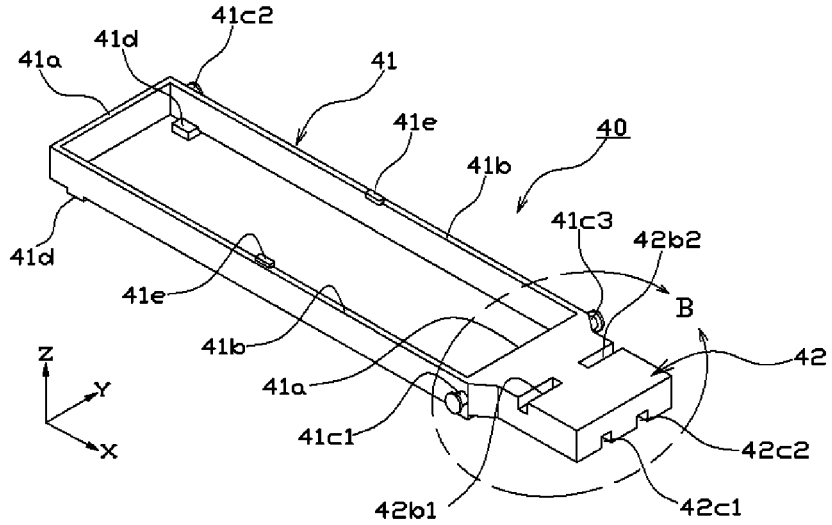
Figure 9:
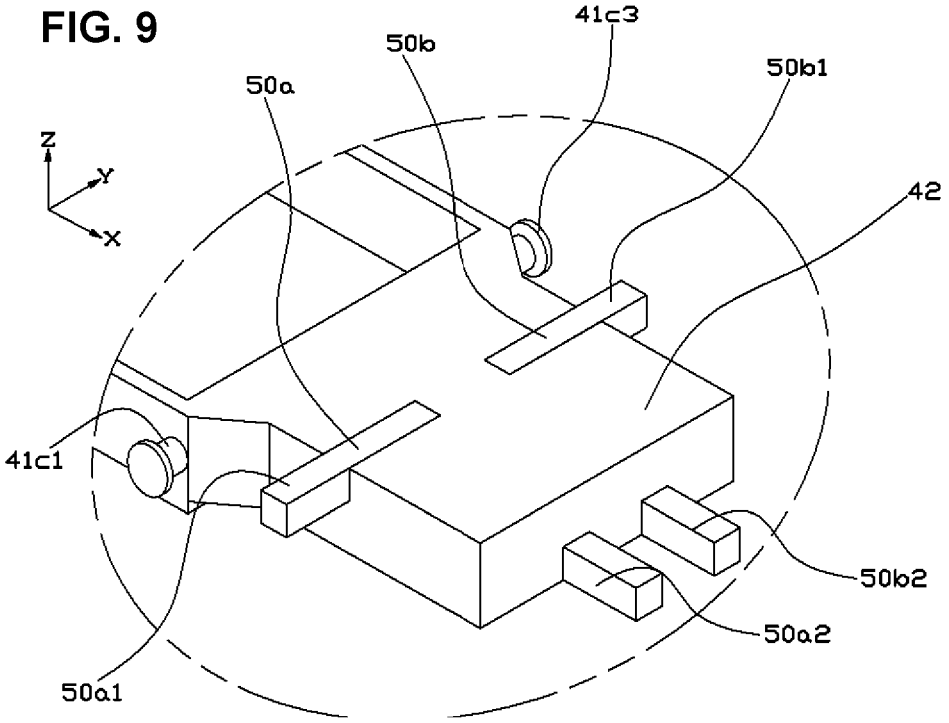
FIG. 9 is an enlarged perspective view of a portion B in FIG. 8 (*d*), showing the situation in which straight metal terminals have been press-fitted into the holder according to the second exemplary mode of embodiment of the present invention, and then the metal terminals have been bent.

An antenna coil 20 according to a second exemplary mode of embodiment of the present invention will be described with reference to FIGS. 8 and 9. In FIGS. 8 and 9, the same reference numerals as those in FIGS. 1 to 7 indicate the same constituent elements, and redundant descriptions are omitted.

In the present exemplary mode of embodiment, only the sectional shapes of the metal terminals 50*a*, 50*b* and the shape of the terminal holding part 42 of the holder 40 are different from those in the first exemplary mode of embodiment.

Square wire having a square cross-section is used for the metal terminals 50*a*, 50*b* in the present example. Furthermore, through holes 42*a*1, 42*a*2 having a square sectional shape in the X-Y plane, and X position restraining grooves 42*b*1, 42*b*2 and Y position restraining grooves 42*c*1, 42*b*2 having square bottoms are provided in the terminal holding part 42 of the holder 40.

With the present example, an effect similar to that in the first exemplary mode of embodiment is produced. In addition, in the antenna coil of this example, because use is made of square cross section metal terminals, and a holder having square through holes and position restraining grooves matching this sectional shape, the metal terminals that have been bent in two directions can be positioned more stably than in the first exemplary mode of embodiment. Note that, when a metal terminal having a square cross section is used, this is not limited to wires having a regular-square cross-section as in the present example, but rather rectangular flat wires having any rectangular cross-section may also be used.

Third Exemplary Mode of Embodiment

Figure 10:
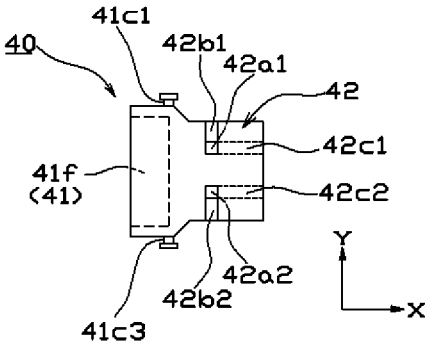
FIG. 10 is a top view of a holder according to a third exemplary mode of embodiment of the present invention.
Figure 11:
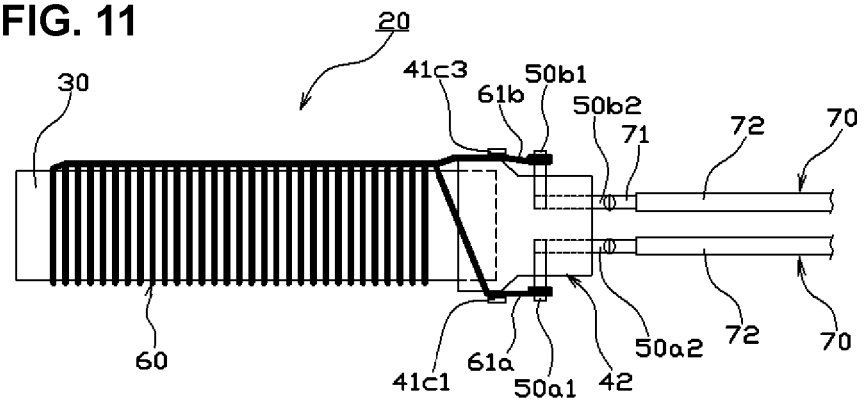
FIG. 11 is a top view of the antenna coil according to the third exemplary mode of embodiment of the present invention.

An antenna coil 20 according to a third exemplary mode of embodiment of the present invention will be described with reference to FIGS. 10 and 11. In FIGS. 10 and 11, the same reference numerals as those in FIGS. 1 to 7 indicate the same constituent elements, and redundant descriptions are omitted.

The structure of the holder of the antenna coil of the present exemplary mode of embodiment is the principal difference with respect to the first exemplary mode of embodiment and the second exemplary mode of embodiment. Specifically, the core holding parts of the holders in the first exemplary mode of embodiment and the second exemplary mode of embodiment are configured to accommodate the entire magnetic material core, but the core holding part of the holder in the present exemplary mode of embodiment is configured to accommodate only one end of the magnetic material core.

For example, if Ni—Zn ferrite or the like having a high resistivity is used as the magnetic material core 30, the coil 60 can be wound directly on the magnetic material core 30. Therefore, in the holder 40 of the present example, the core holding part 41 is constituted only by a recessed receiving part 41*f* that receives only one end of the magnetic material core 30 in the X direction, where the coil 60 is not wound.

With the present example, an effect similar to that in the second exemplary mode of embodiment is produced. In addition, by using the antenna coil of the present example, it is possible to further limit the part costs and manufacturing costs of the antenna device.

Three exemplary modes of embodiment of the present invention were described above, but the present invention is not limited to these exemplary modes of embodiment, and it is a matter of course that the exemplary modes of embodiment described above can be suitably modified or the like, within a range that does not depart from the gist of the present invention.

For example, in the exemplary mode of embodiment described above, both the X position restraining groove and the Y position restraining groove are provided in the holder 40, but so long as it is possible to stably position the metal terminals 50*a*, 50*b* that have been bent in two directions, just one of the X position restraining grooves and the Y position restraining grooves may be provided. Furthermore, there are no particular limitations on the format for the core holding part 41, so long as it can hold the magnetic material core when the coil is wound.

Furthermore, in the exemplary modes of embodiment described above, a case in which the antenna device is mounted on the door handle of a vehicle was described, but the antenna device of the present invention can also be applied to doors in homes, offices and the like.

What is claimed is:

1. An antenna coil comprising: a magnetic material core elongated in the X direction; a holder made of resin mounted on the magnetic material core; a coil wound on the magnetic material core; metal terminals having first ends to which the ends of the coil are electrically connected; and lead wires which are electrically connected to second ends of the metal terminals, wherein:

the holder has a core holding part that holds the magnetic material core and a terminal holding part for holding the metal terminals;

the metal terminals are made of copper covered steel;

the terminal holding part has through holes penetrating in the Z direction and position restraining grooves formed continuous with the through holes, into which at least a portion of the metal terminals are fitted; and with the metal terminals press-fitted into the through holes, the first ends are bent in the Y direction, and the second ends are bent in the X direction, such that the positions thereof are restrained by the position restraining grooves.

2. The antenna coil according to claim 1, wherein the position restraining grooves are provided in a portion corresponding to the first ends of the metal terminals.

3. The antenna coil according to claim 1, wherein the position restraining grooves are provided in a portion corresponding to the second ends of the metal terminals.

4. The antenna coil according to claim 1, wherein the position restraining grooves are provided in a portion corresponding to the first ends of the metal terminals and in a portion corresponding to the second ends of the metal terminals.

5. The antenna coil according to claim 1, wherein the depth of the position restraining grooves in the Z direction is equal to or greater than the height in the Z direction of the metal terminals fitted in the position restraining grooves.

6. The antenna coil according to claim 1, wherein: the copper covered steel is a round wire; and the bottoms of the position restraining grooves are formed in a semicircular shape.

7. The antenna coil according to claim 1, wherein the copper covered steel is a square wire or a flat rectangular wire; and the bottoms of the position restraining grooves are formed in a rectangular shape.

8. An antenna coil comprising:

a magnetic material core elongated in the X direction; a holder made of resin mounted on the magnetic material core;

a coil wound on the magnetic material core; metal terminals having first ends to which the ends of the coil are electrically connected; and lead wires which are electrically connected to second ends of the metal terminals, wherein:

the holder has a core holding part that holds the magnetic material core and a terminal holding part for holding the metal terminals;

the metal terminals are made of copper covered steel;

the terminal holding part has through holes penetrating in the Z direction and position restraining grooves formed continuous with the through holes, into which at least a portion of the metal terminals are fitted;

with the metal terminals press-fitted into the through holes, the first ends are bent in the Y direction, and the second ends are bent in the X direction, such that the positions thereof are restrained by the position restraining grooves;

the position restraining grooves are provided in a portion corresponding to the first ends of the metal terminals and in a portion corresponding to the second ends of the metal terminals; and the depth of the position restraining grooves in the Z direction is equal to or greater than the height in the Z direction of the metal terminals fitted in the position restraining grooves.

9. An antenna device having an antenna coil received in an outer case, wherein the antenna coil comprises: a magnetic material core elongated in the X direction;

a holder made of resin mounted on the magnetic material core;

a coil wound on the magnetic material core;

metal terminals having first ends to which the ends of the coil are electrically connected; and lead wires which are electrically connected to second ends of the metal terminals, wherein:

the holder has a core holding part that holds the magnetic material core and a terminal holding part for holding the metal terminals;

the metal terminals are made of copper covered steel;

the terminal holding part has through holes penetrating in the Z direction and position restraining grooves formed continuous with the through holes, into which at least a portion of the metal terminals are fitted;

with the metal terminals press-fitted into the through holes, the first ends are bent in the Y direction, and the second ends are bent in the X direction, such that the positions thereof are restrained by the position restraining grooves; and the lead wires are led out in the X direction from the outer case.

10. The antenna device according to claim 9, wherein the position restraining grooves are provided in a portion corresponding to the first ends of the metal terminals.

11. The antenna device according to claim 9, wherein the position restraining grooves are provided in a portion corresponding to the second ends of the metal terminals.

12. The antenna device according to claim 9, wherein the position restraining grooves are provided in a portion corresponding to the first ends of the metal terminals and in a portion corresponding to the second ends of the metal terminals.

13. The antenna device according to claim 9, wherein the depth of the position restraining grooves in the Z direction is equal to or greater than the height in the Z direction of the metal terminals fitted in the position restraining grooves.

14. The antenna device according to claim 9, wherein: the copper covered steel is a round wire; and the bottoms of the position restraining grooves are formed in a semicircular shape.

15. The antenna device according to claim 9, wherein: the copper covered steel is a square wire or a flat rectangular wire; and the bottoms of the position restraining grooves are formed in a rectangular shape.

16. The antenna device according to claim 9, wherein a space within the outer case is filled with a filling material made from a soft resin.

* * * * *